US010594033B1

(12) United States Patent
Black et al.

(10) Patent No.: US 10,594,033 B1
(45) **Date of Patent: *Mar. 17, 2020**

(54) SURFACE SCATTERING ANTENNA SYSTEMS WITH REFLECTOR OR LENS

(71) Applicant: Pivotal Commware, Inc., Kirkland, WA (US)

(72) Inventors: Eric James Black, Bothell, WA (US); Jay Howard McCandless, Alpine, CA (US)

(73) Assignee: Pivotal Commware, Inc., Kirkland, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/440,815

(22) Filed: Jun. 13, 2019

Related U.S. Application Data

(63) Continuation of application No. 16/136,119, filed on Sep. 19, 2018, now Pat. No. 10,326,203.

(51) Int. Cl.

| | |
|---|---|
| ***H01Q 3/46*** | (2006.01) |
| ***H01Q 15/00*** | (2006.01) |
| ***H01Q 11/02*** | (2006.01) |

(52) U.S. Cl.
CPC ..... *H01Q 3/46* (2013.01); *H01Q 11/02* (2013.01); *H01Q 15/0086* (2013.01)

(58) Field of Classification Search
CPC .. H01Q 3/34; H01Q 3/44; H01Q 3/46; H01Q 15/02; H01Q 15/14; H01Q 15/142; H01Q 19/10; H01Q 21/06
See application file for complete search history.

(56) References Cited

U.S. PATENT DOCUMENTS

| | | | |
|---|---|---|---|
| 6,133,880 | A | 10/2000 | Grangeat et al. |
| 7,205,949 | B2 | 4/2007 | Turner |
| 9,356,356 | B2 | 5/2016 | Chang et al. |
| 9,385,435 | B2 | 7/2016 | Bily et al. |
| 9,450,310 | B2 | 9/2016 | Bily et al. |
| 9,551,785 | B1 | 1/2017 | Geer |
| 9,711,852 | B2 | 7/2017 | Chen et al. |

(Continued)

FOREIGN PATENT DOCUMENTS

| | | | |
|---|---|---|---|
| CN | 106797074 | A | 5/2017 |
| JP | 936656 | A | 2/1997 |

(Continued)

OTHER PUBLICATIONS

U.S. Appl. No. 14/510,947, filed Oct. 9, 2014, pp. 1-76.

(Continued)

*Primary Examiner* — Hoang V Nguyen
(74) *Attorney, Agent, or Firm* — John W. Branch; Lowe Graham Jones PLLC

(57) ABSTRACT

A system for forming a beam includes one or more wave sources; one or more surface scattering antennas (for example, one or more holographic metasurface antennas) coupled to the one or more wave sources, wherein each of the one or more surface scattering antennas comprises an array of scattering elements that are dynamically adjustable in response to one or more waves provided by the one or more wave sources to produce a beam; and a beam shaper configured to receive the beam from each of the one or more surface scattering antennas and to redirect the beam, preferably, with gain.

30 Claims, 7 Drawing Sheets

(56) References Cited

U.S. PATENT DOCUMENTS

| | | | | |
|---|---|---|---|---|
| 9,806,414 | B2 | 10/2017 | Chen et al. | |
| 9,806,415 | B2 | 10/2017 | Chen et al. | |
| 9,806,416 | B2 | 10/2017 | Chen et al. | |
| 9,812,779 | B2 | 11/2017 | Chen et al. | |
| 10,033,109 | B1 | 7/2018 | Gummalla et al. | |
| 10,225,760 | B1 | 3/2019 | Black | |
| 2002/0196185 | A1 | 12/2002 | Bloy | |
| 2005/0237265 | A1 | 10/2005 | Durham et al. | |
| 2008/0181328 | A1 | 7/2008 | Harel et al. | |
| 2009/0207091 | A1 | 8/2009 | Anagnostou et al. | |
| 2010/0248659 | A1 | 9/2010 | Kawabata | |
| 2010/0302112 | A1 | 12/2010 | Lindenmeier et al. | |
| 2012/0194399 | A1 | 8/2012 | Bily et al. | |
| 2013/0069834 | A1 | 3/2013 | Duerksen | |
| 2014/0094217 | A1 | 4/2014 | Stafford | |
| 2014/0171811 | A1 | 6/2014 | Lin et al. | |
| 2014/0293904 | A1 | 10/2014 | Dai et al. | |
| 2015/0109178 | A1 | 4/2015 | Hyde et al. | |
| 2015/0109181 | A1 | 4/2015 | Hyde et al. | |
| 2015/0116153 | A1 | 4/2015 | Chen et al. | |
| 2015/0162658 | A1* | 6/2015 | Bowers | H01Q 15/006 342/385 |
| 2015/0222021 | A1 | 8/2015 | Stevenson et al. | |
| 2015/0276926 | A1* | 10/2015 | Bowers | G01S 13/887 342/5 |
| 2015/0276928 | A1 | 10/2015 | Bowers et al. | |
| 2015/0288063 | A1 | 10/2015 | Johnson et al. | |
| 2015/0318618 | A1 | 11/2015 | Chen et al. | |
| 2015/0372389 | A1 | 12/2015 | Chen et al. | |
| 2016/0037508 | A1 | 2/2016 | Sun | |
| 2016/0149308 | A1 | 5/2016 | Chen et al. | |
| 2016/0149309 | A1 | 5/2016 | Chen et al. | |
| 2016/0149310 | A1 | 5/2016 | Chen et al. | |
| 2016/0164175 | A1 | 6/2016 | Chen et al. | |
| 2016/0174241 | A1 | 6/2016 | Ansari et al. | |
| 2016/0241367 | A1 | 8/2016 | Irmer et al. | |
| 2016/0345221 | A1 | 11/2016 | Axmon et al. | |
| 2017/0127295 | A1 | 5/2017 | Black et al. | |
| 2017/0127332 | A1 | 5/2017 | Axmon et al. | |
| 2017/0155193 | A1 | 6/2017 | Black et al. | |
| 2017/0187123 | A1 | 6/2017 | Black et al. | |
| 2017/0187426 | A1 | 6/2017 | Su et al. | |
| 2017/0238141 | A1 | 8/2017 | Lindoff et al. | |
| 2017/0339575 | A1 | 11/2017 | Kim et al. | |
| 2018/0027555 | A1 | 1/2018 | Kim et al. | |
| 2018/0066991 | A1 | 3/2018 | Mueller et al. | |
| 2018/0233821 | A1 | 8/2018 | Pham et al. | |
| 2018/0270729 | A1 | 9/2018 | Ramachandra et al. | |
| 2018/0337445 | A1 | 11/2018 | Sullivan et al. | |

FOREIGN PATENT DOCUMENTS

| | | | |
|---|---|---|---|
| JP | 200781648 | A | 3/2007 |
| JP | 2007306273 | A | 11/2007 |
| JP | 2014207626 | A | 10/2014 |
| KR | 10 2016 011310 | A | 9/2016 |
| WO | 2015196044 | A1 | 12/2015 |
| WO | 2017014842 | A1 | 1/2017 |

OTHER PUBLICATIONS

Office Communication for U.S. Appl. No. 15/925,612 dated Jun. 15, 2018, pp. 1-12.
Office Communication for U.S. Appl. No. 15/870,758 dated Oct. 1, 2018, pp. 1-19.
Office Communication for U.S. Appl. No. 16/049,630 dated Oct. 4, 2018, pp. 1-17.
Office Communication for U.S. Appl. No. 16/136,119 dated Nov. 23, 2018, pp. 1-16.
Office Communication for U.S. Appl. No. 16/136,119 dated Mar. 15, 2019, pp. 1-12.
Office Communication for U.S. Appl. No. 16/049,630 dated Apr. 12, 2019, pp. 1-20.
Office Communication for U.S. Appl. No. 16/268,469 dated May 16, 2019, pp. 1-29.
Office Communication for U.S. Appl. No. 16/280,939 dated May 13, 2019, pp. 1-28.
Office Communication for U.S. Appl. No. 16/292,022 dated Jun. 7, 2019, pp. 1-25.
Office Communication for U.S. Appl. No. 16/358,112 dated May 15, 2019, pp. 1-29.
International Search Report and Written Opinion for International Patent Application No. PCT/US2019/022942 dated Jul. 4, 2019, pp. 1-12.
Yurduseven et al., "Dual-Polarization Printed Holographic Multibeam Metasurface Antenna" Aug. 7, 2017, IEEE Antennas and Wireless Propagation Letters. pp. 10.1109/LAWP.2017. pp. 1-4.
Office Communication for U.S. Appl. No. 16/049,630 dated Jun. 24, 2019, pp. 1-7.
Office Communication for U.S. Appl. No. 16/280,939 dated Jul. 18, 2019, pp. 1-21.
International Search Report and Written Opinion for International Patent Application No. PCT/US2019/022987 dated Jul. 2, 2019, pp. 1-13.
Office Communication for U.S. Appl. No. 16/049,630 dated Aug. 7, 2019, pp. 1-36.
Office Communication for U.S. Appl. No. 16/292,022 dated Sep. 23, 2019, pp. 1-32.
Office Communication for U.S. Appl. No. 16/268,469 dated Sep. 10, 2019, pp. 1-37.
International Search Report and Written Opinion for International Patent Application No. PCT/US2019/047093 dated Oct. 21, 2019, pp. 1-14.
Office Communication for U.S. Appl. No. 16/568,096 dated Oct. 24, 2019, pp. 1-18.
International Search Report and Written Opinion for International Patent Application No. PCT/US2019/041053 dated Aug. 27, 2019, pp. 1-15.

* cited by examiner

SURFACE SCATTERING ANTENNA SYSTEMS WITH REFLECTOR OR LENS

CROSS-REFERENCE TO RELATED APPLICATION(S)

This Utility Patent Application is a Continuation of U.S. patent application Ser. No. 16/136,119 filed on Sep. 19, 2018, now U.S. Pat. No. 10,326,203 issued on Jun. 17, 2019, the benefit of which is claimed under 35 U.S.C. § 120, and the contents of which is further incorporated in entirety by reference.

TECHNICAL FIELD

The present invention relates generally to a system that utilizes one or more surface scattering antennas in combination with a reflector or lens. The present invention is also directed to systems and methods for changing the gain of an object wave generated by one or more of the surface scattering antennas.

BACKGROUND

The principal function of an antenna is to couple an electromagnetic wave guided within the antenna structure to an electromagnetic wave propagating in free space. Surface scattering antennas, such as holographic metasurface antennas (HMAs), use scattering elements to generate an object wave in response to a reference wave. For at least some applications, it is useful to increase the system aperture without adding more scattering elements to the HMA.

DETAILED DESCRIPTION OF THE INVENTION

Figure 1A:
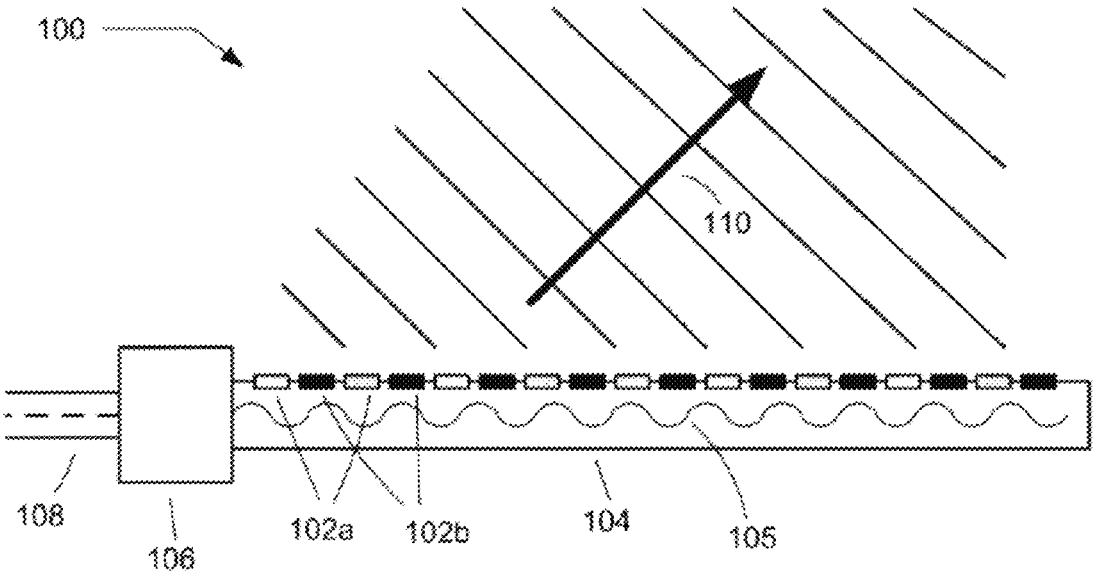
FIG. 1A shown an embodiment of an exemplary surface scattering antenna with multiple varactor elements arranged to propagate electromagnetic waves in such a way as to form an exemplary instance of holographic metasurface antennas (HMA)

Various embodiments now will be described more fully hereinafter with reference to the accompanying drawings, which form a part hereof, and which show, by way of illustration, specific embodiments by which the invention may be practiced. The embodiments may, however, be embodied in many different forms and should not be construed as limited to the embodiments set forth herein; rather, these embodiments are provided so that this disclosure will be thorough and complete, and will fully convey the scope of the embodiments to those skilled in the art. Among other things, the various embodiments may be methods, systems, media, or devices. Accordingly, the various embodiments may take the form of an entirely hardware embodiment, an entirely software embodiment, or an embodiment combining software and hardware aspects. The following detailed description is, therefore, not to be taken in a limiting sense.

Throughout the specification and claims, the following terms take the meanings explicitly associated herein, unless the context clearly dictates otherwise. The phrase "in one embodiment" or "in at least one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

The following briefly describes embodiments of the invention in order to provide a basic understanding of some aspects of the invention. This brief description is not intended as an extensive overview. It is not intended to identify key or critical elements, or to delineate or otherwise narrow the scope. Its purpose is merely to present some concepts in a simplified form as a prelude to the more detailed description that is presented later.

Briefly stated, various embodiments are directed to a method, arrangement, or system for producing a beam with one or more surface scattering antennas and directing that beam to a beam shaper (such as a reflector or lens) which then redirects the beam and is arranged to provide zero, positive, or negative gain. In the discussion below, holographic metasurface antennas (HMAs) will be used as an example, but it will be understood that other surface scattering antennas can be used in place of the HMAs.

Illustrated Operating Environment

In one or more embodiments, a surface scattering antenna, such as an HMA, may use an arrangement of controllable elements to produce an object wave that forms a beam. Also, in one or more embodiments, the controllable elements may employ individual electronic circuits, such as varactors, that have two or more different states. In this way, an object wave can be modified by changing the states of the electronic circuits for one or more of the controllable elements. A control function, such as a hologram function, can be employed to define a current state of the individual controllable elements for a particular object wave and beam. In one or more embodiments, the hologram function can be predetermined or dynamically created in real time in response to various inputs and/or conditions. In one or more embodiments, a library of predetermined hologram functions may be provided. In the one or more embodiments, any type of HMA can be used to that is capable of producing the beams described herein.

FIG. 1A illustrates one embodiment of an HMA which takes the form of a surface scattering antenna 100 (i.e., an HMA) that includes multiple scattering elements 102*a*, 102*b* that are distributed along a wave-propagating structure 104 or other arrangement through which a reference wave 105 can be delivered to the scattering elements. The wave propagating structure 104 may be, for example, a microstrip, a coplanar waveguide, a parallel plate waveguide, a dielectric rod or slab, a closed or tubular waveguide, a substrate-integrated waveguide, or any other structure capable of supporting the propagation of a reference wave 105 along or within the structure. A reference wave 105 is input to the wave-propagating structure 104. The scattering elements 102*a*, 102*b* may include scattering elements that are embedded within, positioned on a surface of, or positioned within an evanescent proximity of, the wave-propagation structure 104. Examples of such scattering elements include, but are not limited to, those disclosed in U.S. Pat. Nos. 9,385,435; 9,450,310; 9,711,852; 9,806,414; 9,806,415; 9,806,416; and 9,812,779 and U.S. Patent Applications Publication Nos. 2017/0127295; 2017/0155193; and 2017/0187123, all of which are incorporated herein by reference in their entirety. Also, any other suitable types or arrangement of scattering elements can be used.

The surface scattering antenna may also include at least one feed connector 106 that is configured to couple the wave-propagation structure 104 to a feed structure 108 which is coupled to a reference wave source (not shown). The feed structure 108 may be a transmission line, a waveguide, or any other structure capable of providing an electromagnetic signal that may be launched, via the feed connector 106, into the wave-propagating structure 104. The feed connector 106 may be, for example, a coaxial-to-microstrip connector (e.g. an SMA-to-PCB adapter), a coaxial-to-waveguide connector, a mode-matched transition section, etc.

The scattering elements 102*a*, 102*b* are adjustable scattering elements having electromagnetic properties that are adjustable in response to one or more external inputs. Adjustable scattering elements can include elements that are adjustable in response to voltage inputs (e.g. bias voltages for active elements (such as varactors, transistors, diodes) or for elements that incorporate tunable dielectric materials (such as ferroelectrics or liquid crystals)), current inputs (e.g. direct injection of charge carriers into active elements), optical inputs (e.g. illumination of a photoactive material), field inputs (e.g. magnetic fields for elements that include nonlinear magnetic materials), mechanical inputs (e.g. MEMS, actuators, hydraulics), or the like. In the schematic example of FIG. 1A, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties.

In the example of FIG. 1A, the scattering elements 102*a*, 102*b* have first and second couplings to the reference wave 105 that are functions of the first and second electromagnetic properties, respectively. For example, the first and second couplings may be first and second polarizabilities of the scattering elements at the frequency or frequency band of the reference wave. On account of the first and second couplings, the first and second scattering elements 102*a*, 102*b* are responsive to the reference wave 105 to produce a plurality of scattered electromagnetic waves having amplitudes that are functions of (e.g. are proportional to) the respective first and second couplings. A superposition of the scattered electromagnetic waves comprises an electromagnetic wave that is depicted, in this example, as an object wave 110 that radiates from the surface scattering antenna 100.

FIG. 1A illustrates a one-dimensional array of scattering elements 102*a*, 102*b*. It will be understood that two- or three-dimensional arrays can also be used. In addition, these arrays can have different shapes. Moreover, the array illustrated in FIG. 1A is a regular array of scattering elements 102*a*, 102*b* with equidistant spacing between adjacent scattering elements, but it will be understood that other arrays may be irregular or may have different or variable spacing between adjacent scattering elements.

Figure 1B:
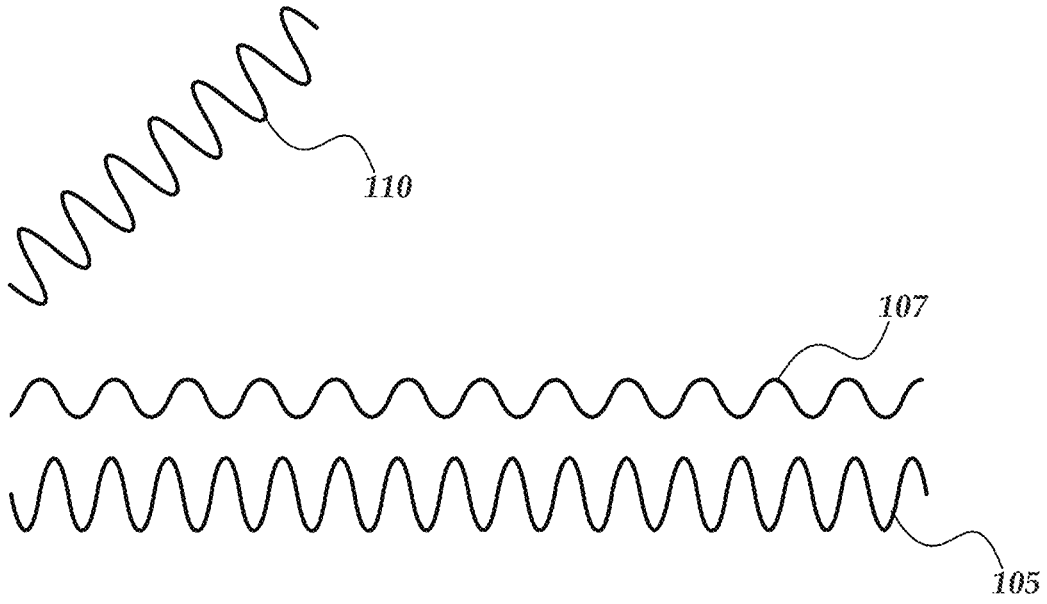
FIG. 1B shows a representation of one embodiment of a synthetic array illustrating a reference waveform and a hologram waveform (modulation function) that in combination provide an object waveform of electromagnetic waves.
Figure 1C:
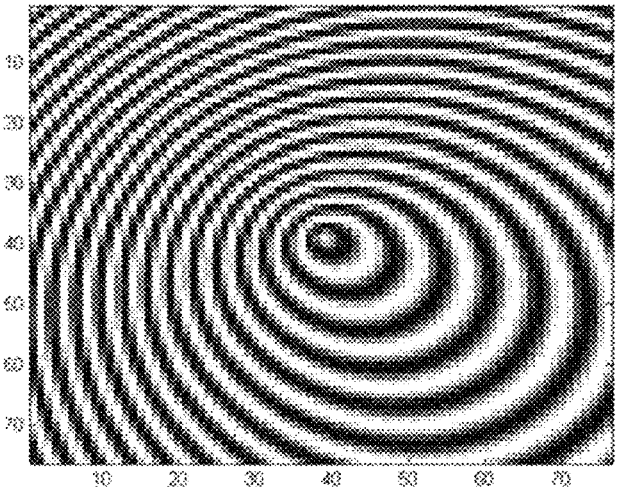
FIG. 1C shows an embodiment of an exemplary modulation function for an exemplary surface scattering antenna.
Figure 1D:
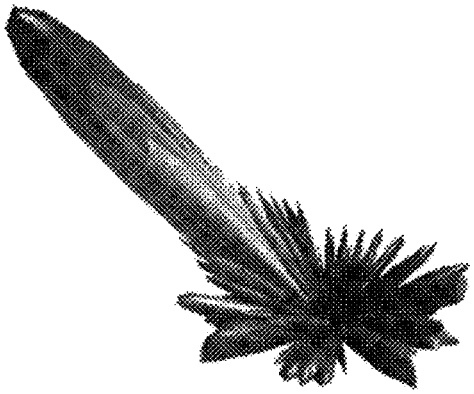
FIG. 1D shows an embodiment of an exemplary beam of electromagnetic waves generated by the modulation function of FIG. 1C.

The array of scattering elements 102*a*, 102*b* can be used to produce a far-field beam pattern that at least approximates a desired beam pattern by applying a modulation pattern 107 (e.g., a hologram function, H) to the scattering elements receiving the reference wave ($\psi_{ref}$) 105 from a reference wave source, as illustrated in FIG. 1B. Although the modulation pattern or hologram function 107 in FIG. 1B is illustrated as sinusoidal, it will be recognized non-sinusoidal functions (including non-repeating or irregular functions) may also be used. FIG. 1C illustrates one example of a modulation pattern and FIG. 1D illustrates one example of a beam generated using that modulation pattern.

In at least some embodiments, a computing system can calculate, select (for example, from a look-up table or database of modulation patterns) or otherwise determine the modulation pattern to apply to the scattering elements 102*a*, 102*b* receiving the RF energy that will result in an approximation of desired beam pattern. In at least some embodiments, a field description of a desired far-field beam pattern is provided and, using a transfer function of free space or any other suitable function, an object wave ($\psi_{obj}$) 110 at an antenna's aperture plane can be determined that results in the desired far-field beam pattern being radiated. The modulation function (e.g., hologram function) can be determined which will scatter the reference wave 105 into the object wave 110. The modulation function (e.g., hologram function) is applied to scattering elements 102*a*, 102*b*, which are excited by the reference wave 105, to form an approximation of an object wave 110 which in turn radiates from the aperture plane to at least approximately produce the desired far-field beam pattern.

In at least some embodiments, the hologram function H (i.e., the modulation function) is equal the complex conjugate of the reference wave and the object wave, i.e., $\psi_{ref}^{*}\psi_{obj}$. Examples of such arrays, antennas, and the like can be found at U.S. Pat. Nos. 9,385,435; 9,450,310; 9,711,852; 9,806,414; 9,806,415; 9,806,416; and 9,812,779 and U.S. Patent Applications Publication Nos. 2017/0127295; 2017/0155193; and 2017/0187123, all of which are incorporated herein by reference in their entirety. In at least some embodiments, the surface scattering antenna may be adjusted to provide, for example, a selected beam direction (e.g. beam steering), a selected beam width or shape (e.g. a fan or pencil beam having a broad or narrow beam width), a selected arrangement of nulls (e.g. null steering), a selected arrangement of multiple beams, a selected polarization state (e.g. linear, circular, or elliptical polarization), a selected overall phase, or any combination thereof. Alternatively or additionally, embodiments of the surface scattering antenna may be adjusted to provide a selected near field radiation profile, e.g. to provide near-field focusing or near-field nulls.

The surface scattering antenna can be considered a holographic beamformer which, at least in some embodiments, is dynamically adjustable to produce a far-field radiation pattern or beam. In some embodiments, the surface scattering antenna includes a substantially one-dimensional wave-propagating structure 104 having a substantially one-dimensional arrangement of scattering elements. In other embodiments, the surface scattering antenna includes a substantially two-dimensional wave-propagating structure 104 having a substantially two-dimensional arrangement of scattering elements. In at least some embodiments, the array of scattering elements 102*a*, 102*b* can be used to generate a narrow, directional far-field beam pattern, as illustrated, for example, in FIG. 1C. It will be understood that beams with other shapes can also be generated using the array of scattering elements 102*a*, 102*b*.

In at least some of the embodiments, a relatively narrow far-field beam pattern can be generated using a holographic metasurface antenna (HMA). In at least some embodiments, by manipulating the holographic function, the beam from the HMA can be scanned along one or more directions. For example, a one-dimensional array of scattering elements can be used to scan the beam along one dimension by alter the holographic function and a two-dimensional array of scattering elements can be used to scan the beam along two dimensions by altering the holographic function.

Figure 2B:
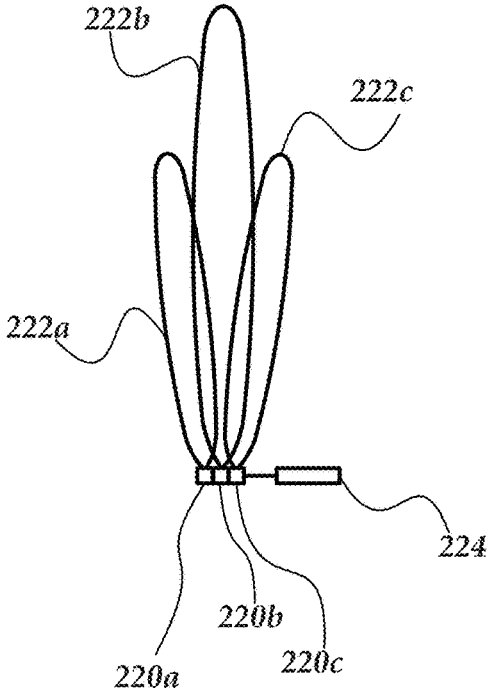
FIG. 2B shows a side view of another embodiment of an exemplary arrangement of multiple instances of HMAs.
Figure 2A:
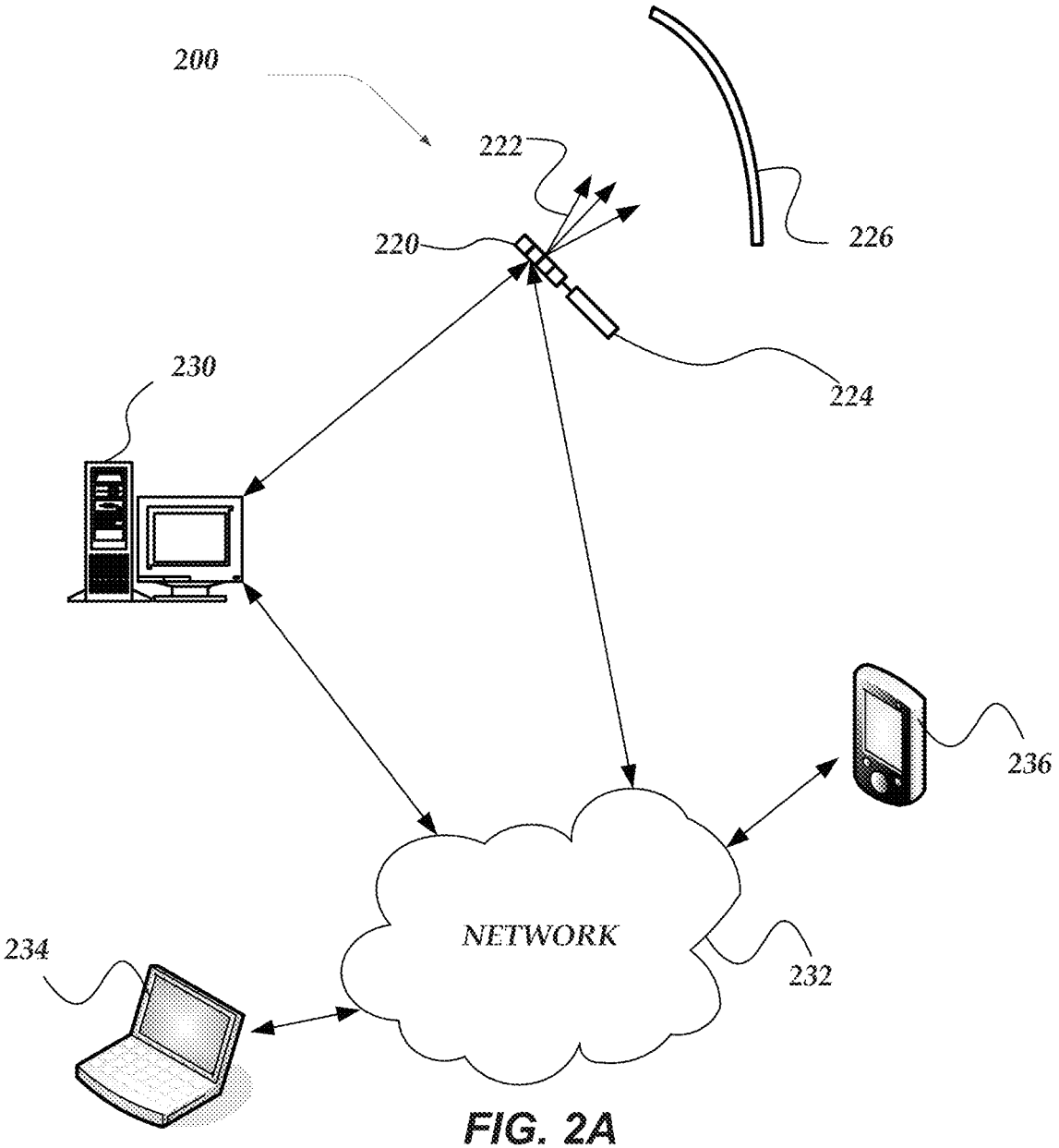
FIG. 2A shows a side view an embodiment of an exemplary environment, including an arrangement of multiple instances of HMAs propagating beams, in which various embodiments of the invention may be implemented.

FIG. 2A illustrates one embodiment of a beam-forming system 200 with an HMA (e.g., a surface scattering antenna or holographic beamformer (HBF)) 220 that produces a beam 222 (i.e., a far-field radiation pattern) and is coupled to a reference wave source 224 (or multiple reference wave sources). In some embodiments, multiple HMAs 220*a*, 220*b*, 220*c* forming multiple beams 222*a*, 222*b*, 222*c* may be included, as illustrated in FIG. 2B and described in U.S. patent application Ser. No. 15/870,758, incorporated herein by reference. Unless indicated otherwise, for convenience the term "beam" will be used for both the near-field and far-field radiation pattern, although it will be understood that the far-field beam will be formed from emitted radiation pattern from one or more HMAs The system 200 further includes a beam shaper 226 that receives the beam 222 from the HMA and redirects the beam. As described herein, the beam shaper 226 may be a reflector or a lens or other arrangement that alters the beam path. In at least some embodiments, the beam shaper 226 is employed to produce zero, positive, or negative gain.

In at least some embodiments, the system 200 also includes, or is coupled to, a computer device 230 or other control device that can control the HMA 220, the reference wave source 224, or any other components of the system, or any combination thereof. For example, the computer device 230 may be capable of dynamically changing the HMA (e.g., dynamically alter the hologram function) to modify the beam generated using the HMA. Alternatively, or additionally, the system 200 may include, or be coupled to, a network 232 which is in turn coupled to a computer device, such as computer device 234 or mobile device 236. The computer device 234 or mobile device 232 can control the HMA 220, the reference wave source 224, or any other components of the system.

Various embodiments of a computer device 230, 234 (which may also be a mobile device 232) are described in more detail below in conjunction with FIG. 3. Briefly, however, computer device 230, 234 includes virtually various computer devices enabled to control the arrangement 200. Based on the desired beam pattern, the computer device 230, 234 may alter or otherwise modify the HMA 220.

Network 232 may be configured to couple network computers with other computing devices, including computer device 230, computer device 234, mobile device 236, HMA 220, or reference wave source 224 or any combination thereof. Network 232 may include various wired and/or wireless technologies for communicating with a remote device, such as, but not limited to, USB cable, Bluetooth®, Wi-Fi®, or the like. In some embodiments, network 232 may be a network configured to couple network computers with other computing devices. In various embodiments, information communicated between devices may include various kinds of information, including, but not limited to, processor-readable instructions, remote requests, server responses, program modules, applications, raw data, control data, system information (e.g., log files), video data, voice data, image data, text data, structured/unstructured data, or the like. In some embodiments, this information may be communicated between devices using one or more technologies and/or network protocols.

In some embodiments, such a network may include various wired networks, wireless networks, or various combinations thereof. In various embodiments, network 232 may be enabled to employ various forms of communication technology, topology, computer-readable media, or the like, for communicating information from one electronic device to another. For example, network 232 can include—in addition to the Internet—LANs, WANs, Personal Area Networks (PANs), Campus Area Networks, Metropolitan Area Networks (MANs), direct communication connections (such as through a universal serial bus (USB) port), or the like, or various combinations thereof.

In various embodiments, communication links within and/or between networks may include, but are not limited to, twisted wire pair, optical fibers, open air lasers, coaxial cable, plain old telephone service (POTS), wave guides, acoustics, full or fractional dedicated digital lines (such as T1, T2, T3, or T4), E-carriers, Integrated Services Digital Networks (ISDNs), Digital Subscriber Lines (DSLs), wireless links (including satellite links), or other links and/or carrier mechanisms known to those skilled in the art. Moreover, communication links may further employ various ones of a variety of digital signaling technologies, including without limit, for example, DS-0, DS-1, DS-2, DS-3, DS-4, OC-3, OC-12, OC-48, or the like. In some embodiments, a router (or other intermediate network device) may act as a link between various networks—including those based on different architectures and/or protocols—to enable information to be transferred from one network to another. In other embodiments, remote computers and/or other related electronic devices could be connected to a network via a modem and temporary telephone link. In essence, network 232 may include various communication technologies by which information may travel between computing devices.

Network 232 may, in some embodiments, include various wireless networks, which may be configured to couple various portable network devices, remote computers, wired networks, other wireless networks, or the like. Wireless networks may include various ones of a variety of sub-networks that may further overlay stand-alone ad-hoc networks, or the like, to provide an infrastructure-oriented connection for at least client computer. Such sub-networks may include mesh networks, Wireless LAN (WLAN) networks, cellular networks, or the like. In one or more of the various embodiments, the system may include more than one wireless network.

Network 232 may employ a plurality of wired and/or wireless communication protocols and/or technologies. Examples of various generations (e.g., third (3G), fourth (4G), or fifth (5G)) of communication protocols and/or technologies that may be employed by the network may include, but are not limited to, Global System for Mobile communication (GSM), General Packet Radio Services (GPRS), Enhanced Data GSM Environment (EDGE), Code Division Multiple Access (CDMA), Wideband Code Division Multiple Access (W-CDMA), Code Division Multiple Access 2000 (CDMA2000), High Speed Downlink Packet Access (HSDPA), Long Term Evolution (LTE), Universal Mobile Telecommunications System (UMTS), Evolution-Data Optimized (Ev-DO), Worldwide Interoperability for Microwave Access (WiMax), time division multiple access (TDMA), Orthogonal frequency-division multiplexing (OFDM), ultra-wide band (UWB), Wireless Application Protocol (WAP), user datagram protocol (UDP), transmission control protocol/Internet protocol (TCP/IP), various portions of the Open Systems Interconnection (OSI) model protocols, session initiated protocol/real-time transport protocol (SIP/RTP), short message service (SMS), multimedia messaging service (MMS), or various ones of a variety of other communication protocols and/or technologies. In essence, the network may include communication technologies by which information may travel between light source 104, photon receiver 106, and tracking computer device 110, as well as other computing devices not illustrated.

In various embodiments, at least a portion of network 232 may be arranged as an autonomous system of nodes, links, paths, terminals, gateways, routers, switches, firewalls, load balancers, forwarders, repeaters, optical-electrical converters, or the like, which may be connected by various communication links. These autonomous systems may be configured to self-organize based on current operating conditions and/or rule-based policies, such that the network topology of the network may be modified.

Illustrative Computer Device

Figure 3:
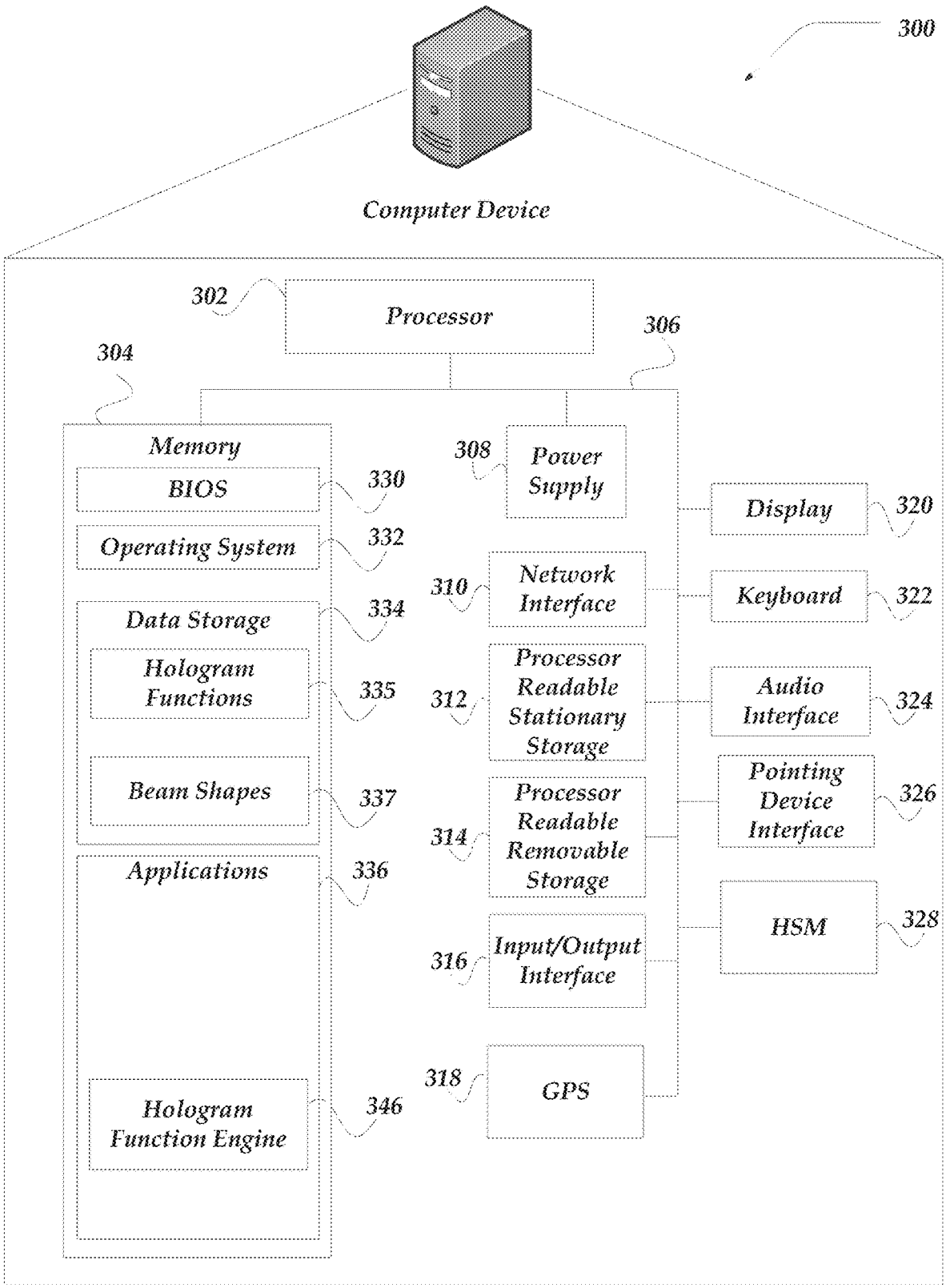
FIG. 3 shows an embodiment of an exemplary computer device that may be included in a system such as that shown in FIG. 2A.

FIG. 3 shows one embodiment of an exemplary computer device 300 that may be included in an exemplary system implementing one or more of the various embodiments. Computer device 300 may include many more or less components than those shown in FIG. 3. However, the components shown are sufficient to disclose an illustrative embodiment for practicing these innovations. Computer device 300 may include a desktop computer, a laptop computer, a server computer, a client computer, and the like. Computer device 300 may represent, for example, one embodiment of one or more of a laptop computer, smartphone/tablet, computer device 230, 234 or mobile device 236 of FIG. 2A or may be part of the system 200, such as a part of one or more of the HMAs 220*a*, 220*b*, 220*c*, 220*d*, or reference wave source 224 or the like.

As shown in FIG. 3, computer device 300 includes one or more processors 302 that may be in communication with one or more memories 304 via a bus 306. In some embodiments, one or more processors 302 may be comprised of one or more hardware processors, one or more processor cores, or one or more virtual processors. In some cases, one or more of the one or more processors may be specialized processors or electronic circuits particularly designed to perform one or more specialized actions, such as, those described herein. Computer device 300 also includes a power supply 308, network interface 310, non-transitory processor-readable stationary storage device 312 for storing data and instructions, non-transitory processor-readable removable storage device 314 for storing data and instructions, input/output interface 316, GPS transceiver 318, display 320, keyboard 322, audio interface 324, pointing device interface 326, and HSM 328, although a computer device 300 may include fewer or more components than those illustrated in FIG. 3 and described herein. Power supply 308 provides power to computer device 300.

Network interface 310 includes circuitry for coupling computer device 300 to one or more networks, and is constructed for use with one or more communication protocols and technologies including, but not limited to, protocols and technologies that implement various portions of the Open Systems Interconnection model (OSI model), global system for mobile communication (GSM), code division multiple access (CDMA), time division multiple access (TDMA), user datagram protocol (UDP), transmission control protocol/Internet protocol (TCP/IP), Short Message Service (SMS), Multimedia Messaging Service (MIMS), general packet radio service (GPRS), WAP, ultra wide band (UWB), IEEE 802.16 Worldwide Interoperability for Microwave Access (WiMax), Session Initiation Protocol/Real-time Transport Protocol (SIP/RTP), or various ones of a variety of other wired and wireless communication protocols. Network interface 310 is sometimes known as a transceiver, transceiving device, or network interface card (NIC). Computer device 300 may optionally communicate with a base station (not shown), or directly with another computer.

Audio interface 324 is arranged to produce and receive audio signals such as the sound of a human voice. For example, audio interface 324 may be coupled to a speaker and microphone (not shown) to enable telecommunication with others and/or generate an audio acknowledgement for some action. A microphone in audio interface 324 can also be used for input to or control of computer device 300, for example, using voice recognition.

Display 320 may be a liquid crystal display (LCD), gas plasma, electronic ink, light emitting diode (LED), Organic LED (OLED) or various other types of light reflective or light transmissive display that can be used with a computer. Display 320 may be a handheld projector or pico projector capable of projecting an image on a wall or other object.

Computer device 300 may also comprise input/output interface 316 for communicating with external devices or computers not shown in FIG. 3. Input/output interface 316 can utilize one or more wired or wireless communication technologies, such as USB™, Firewire™, Wi-Fi™, WiMax, Thunderbolt™, Infrared, Bluetooth™, Zigbee™, serial port, parallel port, and the like.

Also, input/output interface 316 may also include one or more sensors for determining geolocation information (e.g., GPS), monitoring electrical power conditions (e.g., voltage sensors, current sensors, frequency sensors, and so on), monitoring weather (e.g., thermostats, barometers, anemometers, humidity detectors, precipitation scales, or the like), or the like. Sensors may be one or more hardware sensors that collect and/or measure data that is external to computer device 300. Human interface components can be physically separate from computer device 300, allowing for remote input and/or output to computer device 300. For example, information routed as described here through human interface components such as display 320 or keyboard 322 can instead be routed through the network interface 310 to appropriate human interface components located elsewhere on the network. Human interface components include various components that allow the computer to take input from, or send output to, a human user of a computer. Accordingly, pointing devices such as mice, styluses, track balls, or the like, may communicate through pointing device interface 326 to receive user input.

Memory 304 may include Random Access Memory (RAM), Read-Only Memory (ROM), and/or other types of memory. Memory 304 illustrates an example of computer-readable storage media (devices) for storage of information such as computer-readable instructions, data structures, program modules or other data. Memory 304 stores a basic input/output system (BIOS) 330 for controlling low-level operation of computer device 300. The memory also stores an operating system 332 for controlling the operation of computer device 300. It will be appreciated that this component may include a general-purpose operating system such as a version of UNIX, or LINUX™, or a specialized operating system such as Microsoft Corporation's Windows® operating system, or the Apple Corporation's IOS® operating system. The operating system may include, or interface with a Java virtual machine module that enables control of hardware components and/or operating system operations via Java application programs. Likewise, other runtime environments may be included.

Memory 304 may further include one or more data storage 334, which can be utilized by computer device 300 to store, among other things, applications 336 and/or other data. For example, data storage 334 may also be employed to store information that describes various capabilities of computer device 300. In one or more of the various embodiments, data storage 334 may store hologram function information 335 or beam shape information 337. The hologram function information 335 or beam shape information 337 may then be provided to another device or computer based on various ones of a variety of methods, including being sent as part of a header during a communication, sent upon request, or the like. Data storage 334 may also be employed to store social networking information including address books, buddy lists, aliases, user profile information, or the like. Data storage 334 may further include program code, data, algorithms, and the like, for use by one or more processors, such as processor 302 to execute and perform actions such as those actions described below. In one embodiment, at least some of data storage 334 might also be stored on another component of computer device 300, including, but not limited to, non-transitory media inside non-transitory processor-readable stationary storage device 312, processor-readable removable storage device 314, or various other computer-readable storage devices within computer device 300, or even external to computer device 300.

Applications 336 may include computer executable instructions which, if executed by computer device 300, transmit, receive, and/or otherwise process messages (e.g., SMS, Multimedia Messaging Service (MMS), Instant Message (IM), email, and/or other messages), audio, video, and enable telecommunication with another user of another mobile computer. Other examples of application programs include calendars, search programs, email client applications, IM applications, SMS applications, Voice Over Internet Protocol (VOIP) applications, contact managers, task managers, transcoders, database programs, word processing programs, security applications, spreadsheet programs, games, search programs, and so forth. Applications 336 may include hologram function engine 346 that performs actions further described below. In one or more of the various embodiments, one or more of the applications may be implemented as modules and/or components of another application. Further, in one or more of the various embodiments, applications may be implemented as operating system extensions, modules, plugins, or the like.

Furthermore, in one or more of the various embodiments, specialized applications such as hologram function engine 346 may be operative in a networked computing environment to perform specialized actions described herein. In one or more of the various embodiments, these applications, and others, may be executing within virtual machines and/or virtual servers that may be managed in a networked environment such as a local network, wide area network, or cloud-based based computing environment. In one or more of the various embodiments, in this context the applications may flow from one physical computer device within the cloud-based environment to another depending on performance and scaling considerations automatically managed by the cloud computing environment. Likewise, in one or more of the various embodiments, virtual machines and/or virtual servers dedicated to the hologram function engine 346 may be provisioned and de-commissioned automatically.

Also, in one or more of the various embodiments, the hologram function engine 346 or the like may be located in virtual servers running in a networked computing environment rather than being tied to one or more specific physical computer devices.

Further, computer device 300 may comprise HSM 328 for providing additional tamper resistant safeguards for generating, storing and/or using security/cryptographic information such as, keys, digital certificates, passwords, passphrases, two-factor authentication information, or the like. In some embodiments, hardware security module may be employed to support one or more standard public key infrastructures (PKI), and may be employed to generate, manage, and/or store keys pairs, or the like. In some embodiments, HSM 328 may be a stand-alone computer device, in other cases, HSM 328 may be arranged as a hardware card that may be installed in a computer device.

Additionally, in one or more embodiments (not shown in the figures), the computer device may include one or more embedded logic hardware devices instead of one or more CPUs, such as, an Application Specific Integrated Circuits (ASICs), Field Programmable Gate Arrays (FPGAs), Programmable Array Logics (PALs), or the like, or combination thereof. The embedded logic hardware devices may directly execute embedded logic to perform actions. Also, in one or more embodiments (not shown in the figures), the computer device may include one or more hardware microcontrollers instead of a CPU. In one or more embodiments, the one or more microcontrollers may directly execute their own embedded logic to perform actions and access their own internal memory and their own external Input and Output Interfaces (e.g., hardware pins and/or wireless transceivers) to perform actions, such as System On a Chip (SOC), or the like.

Illustrative Use Cases

A surface scattering antenna, such as a holographic metasurface antenna (HMA), or a combination of surface scattering antennas, can generate a beam that can be used for a variety of applications. In some instances, it may be desirable to redirect that beam or produce zero, positive, or negative gain of the beam. The beam from one or more surface scattering antennas can be directed to a beam shaper that then redirects the beam and may provide zero, positive, or negative gain. In the discussion below, HMAs will be used as example, but it will be understood that other surface scattering antennas can be used in place of the HMAs.

Figure 4A:
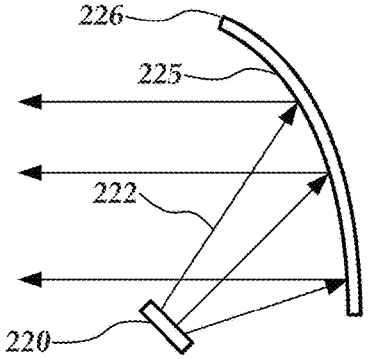
FIG. 4A shows a cross-sectional view of one embodiment of an HMA and a reflector.
Figure 4B:
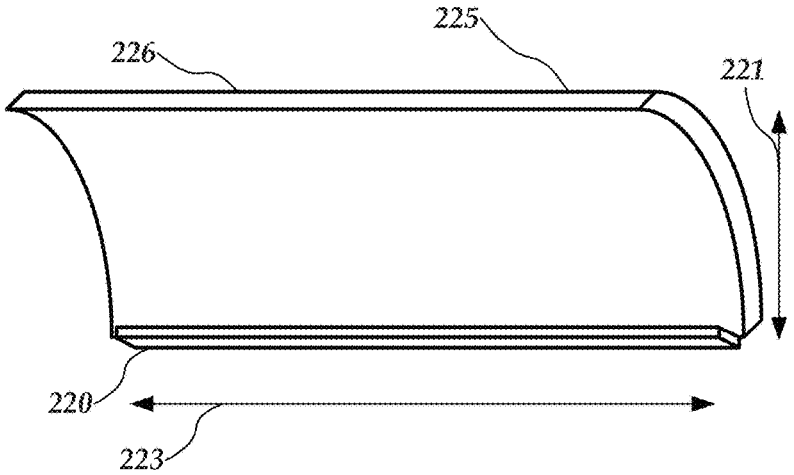
FIG. 4B shows a front view of the HMA and reflector of FIG. 4A.

FIGS. 4A and 4B illustrate one arrangement of an HMA 220 and a beam shaper 226. FIG. 4A is a cross-sectional view and FIG. 4B is a front view. In this illustrated example, the beam shaper 226 takes the form of a reflector or subreflector 225 that is configured to reflect the beam 222 generated by the HMA 220 as illustrated in FIG. 4A. In at least some embodiments, the beam shaper produces zero, positive, or negative gain for the beam.

The beam shaper 226 in FIGS. 4A and 4B has a curved surface. In at least some embodiments, the curved surface of the beam shaper 226 has a single radius of curvature in cross-section, as illustrated in FIG. 4A, with that curved shape extending laterally, as illustrated in FIG. 4B, to form half (or less) of a parabolic cylindrical reflector. Another embodiment of a beam shaper 226 is a reflector or subreflector 225 having the cross-section illustrated in FIG. 5. The beam shaper 226 of FIG. 5 may have a similar arrangement to that illustrated in FIG. 4B so that the beam shaper 226 has a single radius of curvature with that curved shape extending laterally to form a parabolic cylindrical reflector. In other embodiments, the beam shaper 226 can have a radius of curvature in multiple directions, such as a parabolic or dish reflector or the like. Any other types of reflectors can be used including, but not limited to, ellipsoid, hyperboloid, Fresnel, Fourier, and any other suitable reflectors. Moreover, the reflector may be shaped to include multiple radii of curvature or other shapes to obtain a desired output intensity or beam profile. As an example, the curved surface in FIGS. 4A and 4B may be shaped to provide little or no reflection below the bottom edge of the reflector 225 and provide an intensity profile that decreases in intensity from the bottom to the top of the reflector 225 (referring to the orientation of the reflector in FIGS. 4A and 4B) according to a selected profile (for example, an intensity profile that resembles a cosecant or other function that decreases in intensity from bottom to top of the reflector 225). Any other suitable intensity profile may be used and may depend on the application.

Figure 5:
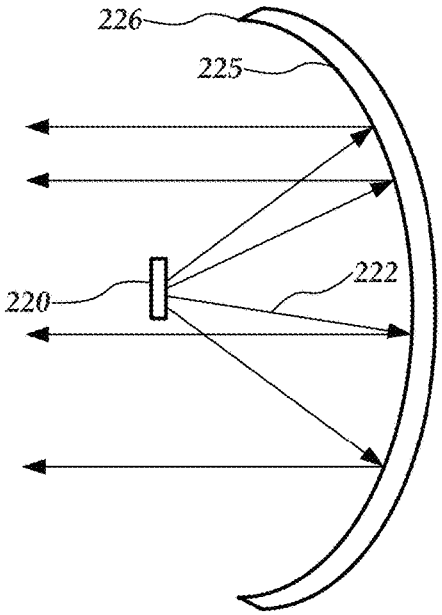
FIG. 5 shows a cross-sectional view of another embodiment of an HMA and a reflector.
Figure 6:
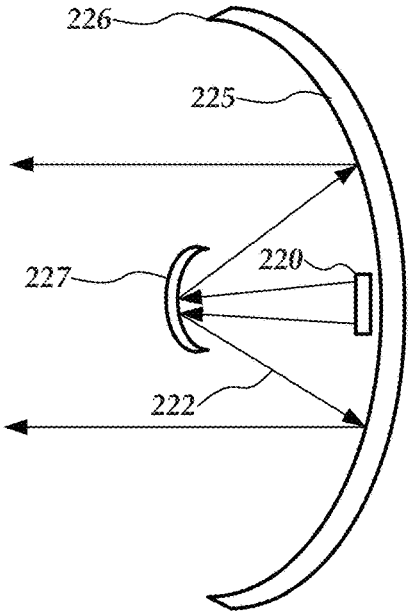
FIG. 6 shows a cross-sectional view of a third embodiment of an HMA and a reflector.

In FIGS. 4A and 4B, the HMA 220 is offset with respect to the beam shaper 226. In FIG. 5, the HMA 220 is centered relative the beam shaper 226. Any other suitable placement of the HMA 220 relative to the beam shaper 226 can also be used. In at least some embodiments, the HMA 220 may be positioned at a focal point of the beam shaper 226. In at least some embodiments, the HMA 22 can be positioned so that a path length of each portion of the beam from the HMA to the beam shaper 226 is equal or nearly equal (for example, differs by no more than 1, 2, 5, or 10%). In at least some embodiments, as illustrated in FIG. 6, an arrangement of HMA 220 and beam shaper 226 can also include a secondary reflector 227 (either convex or concave) so that the beam 222 from the HMA 220 first reflects from the secondary reflector and then is reflected toward the beam shaper.

In at least some embodiments, the HMA 220 is a long, narrow array of scattering elements as illustrated in FIG. 4B. In at least some embodiments, a length of the array is at least two or more times a width of the array. It will be recognized, however, that any other suitable array of scattering elements can be used or that multiple HMAs can be used with the beam shaper 226. In at least some embodiments, the HMA 220 is a single row of scattering elements extending along the length of the HMA. In other embodiments, the HMA 220 can have two, three, four, five, six, eight, ten, twelve, or more rows of scattering elements extending along the length of the HMA. The use of the beam shaper 226 may be advantageous to provide a larger effective aperture for the system with fewer scattering elements than would be needed for a system with a comparable aperture, but no beam shaper. This may reduce one or more of manufacturing costs, power usage, number of control elements, or the like or any combination thereof.

In at least some embodiments, using an appropriate holographic function, the system can be configured to produce a beam 222 that is relatively wide in a first dimension 221 (for example, an elevation or height dimension) and relatively narrow in a second dimension 223 (for example, a lateral dimension corresponding the length of the array of the HMA 220). For example, a ratio of the width in the first dimension over the width in the second dimension can be two or more, e.g., 2, 5, 10, 20, 25, 50, 100, 250, 500, 1000 or greater.

In at least some embodiments, the beam 222 can be scanned along a first axis (for example, the second dimension 223) by altering the holographic function using, for example, an instantiation of the hologram function engine 346 of the computer device 300 (FIG. 3). For example, the beam 222 may be scanned azimuthally along a horizon or some other region of space. If the system illustrated in FIGS. 4A and 4B were rotated ninety degrees the HMA 220 can be used to create a beam 222 that scans along elevation. Any other suitable orientation of the system can be used to provide a desired scanning axis.

As described above, the HMA 220 can act as a holographic beamformer and that the selected far-field radiation pattern of the beam 222 may be achieved prior to, at, or after interaction with the beam shaper 226.

A reflective beam shaper 226 can be formed using any suitable material having a sufficient dielectric including, but not limited to, metal, metallic mesh, or the like. In at least some embodiment, the beam shaper 226 can be made of a perforated metal sheet. Preferably, the holes in the metal sheet are on greater than one quarter of the wavelength of the electromagnetic radiation to be reflected.

Figure 7:
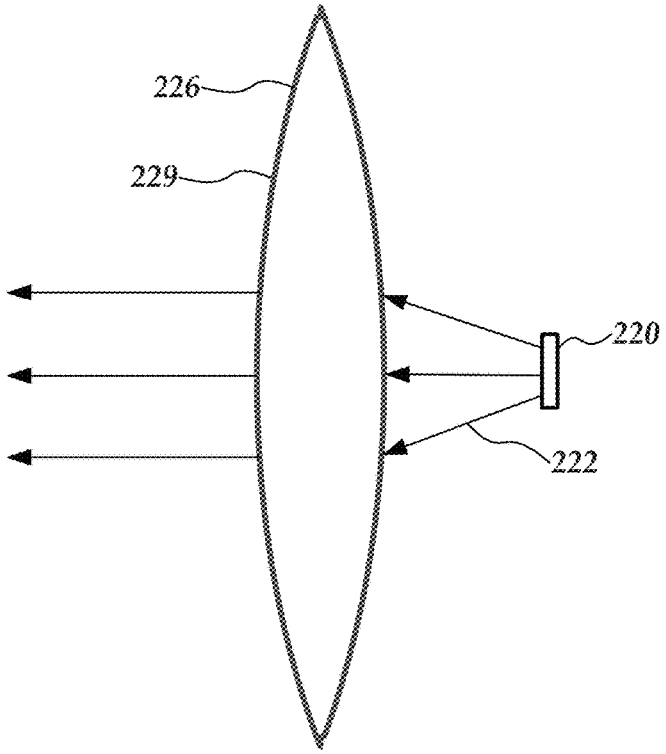
FIG. 7 shows a cross-sectional view of one embodiment of an HMA and a lens.

FIG. 7 illustrates another embodiment of a beam shaper 226 in the form of a lens 229. The beam shaper 226 receives a beam 222 from the HMA 220 and redirects the beam based on the shape and properties of the lens. In at least some embodiments, the HMA 220 is disposed in a focal plane or focal point of the lens 229. In the illustrated embodiment, the beam shaper 226 has the form of a biconvex lens. Any other type of lens may also be used including, but not limited to, biconcave, plano-convex, plano-concave, Fourier, Fresnel, lenticular, cylindrical, or the like.

The lens 229 has at least one curved surface, similar to the reflectors 229 of FIGS. 4A-6. In at least some embodiments, the curved surface of the lens 229 may have a single radius of curvature and the curved structure may extend laterally in a manner similar to that of the reflector 225 illustrated in FIG. 4B. In other embodiments, the lens 229 may have a radius of curvature in multiple directions around the center of the lens.

The lens 229 can be made of any suitable material, such as plastic, glass, or the like, that has a dielectric constant (or index of refraction) different from that of air at the wavelength or wavelengths of electromagnetic radiation in the beam 222. Moreover, the lens may be shaped to obtain a desired output intensity or beam profile.

In at least some embodiments, the HMA 220 is a single row of scattering elements extending along the length of the HMA. In other embodiments, the HMA 220 can have two, three, four, five, six, eight, ten, twelve, or more rows of scattering elements extending along the length of the HMA. The use of the beam shaper 226 may be advantageous to provide a larger effective aperture for the system with fewer scattering elements than would be needed for a system with a comparable aperture, but no beam shaper. This may reduce one or more of manufacturing costs, power usage, number of control elements, or the like or any combination thereof.

Figure 8:
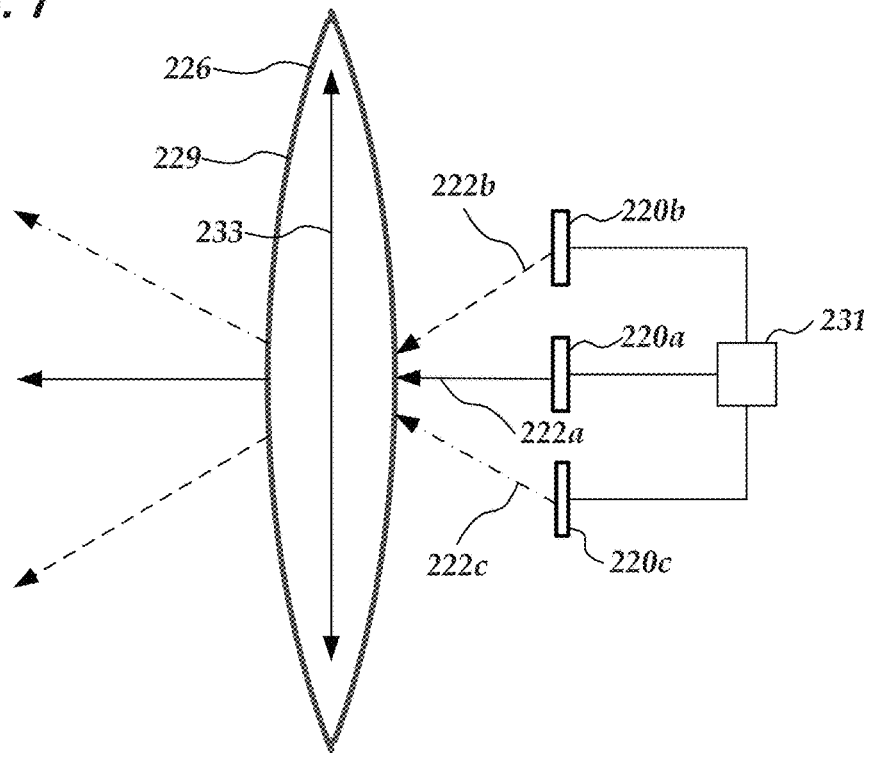
FIG. 8 shows a cross-sectional view of one embodiment of multiple HMAs and a lens.

FIG. 8 illustrates a system with three HMAs 220*a*, 220*b*, 220*c* (which may be separate or may be portions of the same array of scattering elements), a lens 229 (e.g., a beam shaper), and a controller 231 (for example, computer device 230 of FIG. 2A). Each of the HMAs 220*a*, 220*b*, 220*c* can produce a beam 222*a*, 222*b*, 222*c*, respectively. In at least some embodiments, the HMAs 220*a*, 220*b*, 220*c* are disposed in a focal plane of the lens 229. In at least some embodiments, the controller 231 can be configured to switch between the three HMAs 220*a*, 220*b*, 220*c*. This can be useful for scanning along the lens axis 233. HMA 220*b* may be useful for a bottom sector, HMA 220*a* for an intermediate sector, and HMA 220*c* for an upper sector. A similar arrangement with the ability to switch between multiple HMAs can be made using a reflector (for example, any of the reflectors 225 in FIGS. 4A to 6) instead of a lens 229. These arrangements can be used to scan the beam in a second axis and may be used in conjunction with scanning in the first axis by scanning the beam along the length of one of the HMAs.

Figure 9:
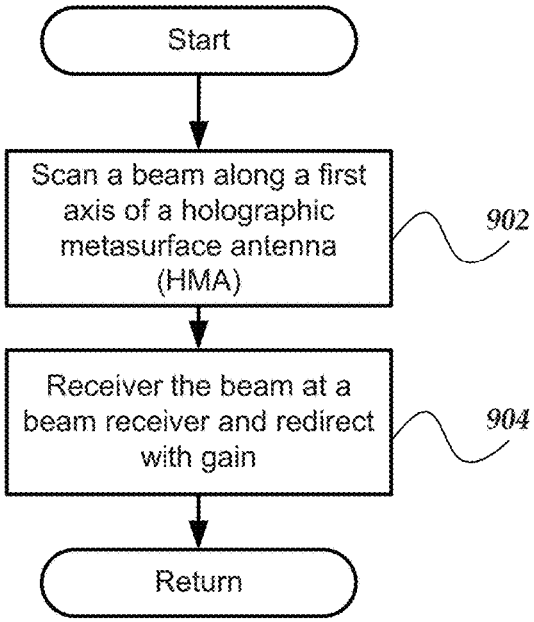
FIG. 9 shows an embodiment of a logical flow diagram for an exemplary method of scanning a beam along a first axis using an HMA and a beam shaper.

FIG. 9 is a flowchart of one method of scanning a beam. In step 902, a beam 222 is scanned along a first axis of at least one holographic metasurface antenna, such as HMA 220 of FIGS. 4A-8. For example, a hologram function engine 346 of computer device 300 (FIG. 3) can be instantiated to repeatedly alter a holographic function for the at least one HMA to adjust the response of the scattering elements of the at least one HMA to scan the beam along the first axis.

In step 904, the beam 222 is directed to, and received by, the beam shaper 226 (such as reflector 225 or lens 229) and redirected with zero, positive, or negative gain. As explained above, in at least some embodiments, this arrangement provides a larger aperture using fewer scattering elements than a configuration without the beam shaper. Steps 902 and 904 can be repeated any number of times.

Figure 10:
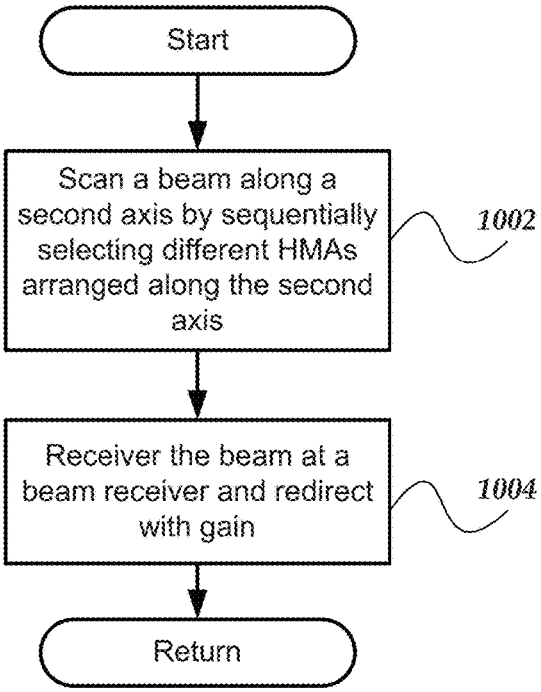
FIG. 10 shows an embodiment of a logical flow diagram for an exemplary method of scanning a beam along a second axis using multiple HMAs and a beam receiver.

FIG. 10 is a flowchart of another method of scanning a beam along a second axis that can be used in conjunction with the method illustrated in FIG. 9. In step 1002, a beam 222 is scanned along a second axis be sequentially selecting different HMAs arranged along the second axis. In step 1004, the beam 222 is directed to, and received by, the beam shaper 226 (such as reflector 225 or lens 229) and redirected with zero, positive, or negative gain.

It will be understood that each block of the flowchart illustrations, and combinations of blocks in the flowchart illustrations, (or actions explained above with regard to one or more systems or combinations of systems) can be implemented by computer program instructions. These program instructions may be provided to a processor to produce a machine, such that the instructions, which execute on the processor, create means for implementing the actions specified in the flowchart block or blocks. The computer program instructions may be executed by a processor to cause a series of operational steps to be performed by the processor to produce a computer-implemented process such that the instructions, which execute on the processor to provide steps for implementing the actions specified in the flowchart block or blocks. The computer program instructions may also cause at least some of the operational steps shown in the blocks of the flowcharts to be performed in parallel. Moreover, some of the steps may also be performed across more than one processor, such as might arise in a multi-processor computer system. In addition, one or more blocks or combinations of blocks in the flowchart illustration may also be performed concurrently with other blocks or combinations of blocks, or even in a different sequence than illustrated without departing from the scope or spirit of the invention.

Additionally, in one or more steps or blocks, may be implemented using embedded logic hardware, such as, an Application Specific Integrated Circuit (ASIC), Field Programmable Gate Array (FPGA), Programmable Array Logic (PAL), or the like, or combination thereof, instead of a computer program. The embedded logic hardware may directly execute embedded logic to perform actions some or all of the actions in the one or more steps or blocks. Also, in one or more embodiments (not shown in the figures), some or all of the actions of one or more of the steps or blocks may be performed by a hardware microcontroller instead of a CPU. In one or more embodiment, the microcontroller may directly execute its own embedded logic to perform actions and access its own internal memory and its own external Input and Output Interfaces (e.g., hardware pins and/or wireless transceivers) to perform actions, such as System On a Chip (SOC), or the like.

The above specification, examples, and data provide a complete description of the manufacture and use of the invention. Since many embodiments of the invention can be made without departing from the spirit and scope of the invention, the invention resides in the claims hereinafter appended.

What is claimed as new and desired to be protected by Letters Patent of the United States is:

1. A system for forming a beam, comprising:

one or more holographic metasurface antennas (HMAs) that include an array of scattering elements that produce one or more beams based on one or more wave signals; and a shaper that passively redirects the one or more beams, wherein a physical arrangement of the shaper provides an aperture that is relatively larger than another aperture provided by the one or more HMAs.

2. The system of claim 1, wherein the array of scattering elements is extended along a length of the one or more HMAs in one or more rows that are substantially less than a number of columns for a width of the one or more HMAs.

3. The system of claim 1, further comprising employing two or more HMAs to separately produce the one or more beams along a first axis and a second axis.

4. The system of claim 1, further comprising switching the production of the one or more beams between two or more HMAs to scan two or more different sectors of a focal plane.

5. The system of claim 1, wherein the one or more HMAs are configured as one or more of a static reflect array, a configurable reflect array, a static transmit array, or a configurable transmit array.

6. The system of claim 1, wherein the shaper further comprises one or more of:

a surface curved along one direction and extending laterally relative to the one direction, wherein the scattering elements of the one or more HMAs extend laterally relative to the one direction of the shaper.

7. The system of claim 1, wherein the shaper further comprises:

one or more reflectors, wherein the one or more reflectors include one or more of a parabolic cylindrical reflector, an ellipsoid reflector, a hyperboloid reflector, or a dish reflector; or one or more lenses, wherein the one or more lenses include one or more of a Fresnel lens, a Fourier lens, a biconcave lens, a plano-convex lens, a plano-concave lens, a lenticular lens, or a cylindrical lens.

8. The system of claim 1, wherein the shaper further comprises providing one of positive, negative or zero gain for the one or more redirected beams.

9. The system of claim 1, further comprising another shaper that is arranged to initially receive the one or more beams produced by the one or more HMAs, wherein the initially received one or more beams is redirected by the other shaper to the shaper that passively redirects the one or more beams.

10. The system of claim 1, further comprising:

one or more processors that execute instructions to perform actions, comprising adjusting a response of the array of scattering elements to scan the one or more beams along one or more axises of the one or more HMAs.

11. A shaper for directing one or more beams, comprising:

a surface that receives the one or more beams produced by an array of scattering elements for one or more holographic metasurface antennas (HMAs) based on one or more wave signals, wherein the surface passively redirects the one or more beams; and wherein a physical arrangement of the surface provides an aperture that is relatively larger than another aperture provided by the one or more HMAs.

12. The shaper of claim 11, wherein the array of scattering elements is extended along a length of the one or more HMAs in one or more rows that are substantially less than a number of columns for a width of the one or more HMAs.

13. The shaper of claim 11, further comprising employing two or more HMAs to separately produce the one or more beams along a first axis and a second axis.

14. The shaper of claim 11, further comprising switching the production of the one or more beams between two or more HMAs to scan two or more different sectors of a focal plane.

15. The shaper of claim 11, wherein the one or more HMAs are configured as one or more of a static reflect array, a configurable reflect array, a static transmit array, or a configurable transmit array.

16. The shaper of claim 11, wherein the shaper further comprises one or more of:

a surface curved along one direction and extending laterally relative to the one direction, wherein the scattering elements of the one or more HMAs extend laterally relative to the one direction of the shaper.

17. The shaper of claim 11, further comprising:

one or more reflectors, wherein the one or more reflectors include one or more of a parabolic cylindrical reflector, an ellipsoid reflector, a hyperboloid reflector, or a dish reflector; or one or more lenses, wherein the one or more lenses include one or more of a Fresnel lens, a Fourier lens, a biconcave lens, a plano-convex lens, a plano-concave lens, a lenticular lens, or a cylindrical lens.

18. The shaper of claim 11, further comprising providing one of positive, negative or zero gain for the one or more redirected beams.

19. The shaper of claim 11, further comprising another shaper that is arranged to initially receive the one or more beams provided by the one or more HMAs, wherein the initially received one or more beams is redirected by the other shaper to the shaper that passively redirects the one or more beams.

20. The shaper of claim 11, further comprising:

one or more processors that execute instructions to perform actions, comprising adjusting a response of the array of scattering elements to scan the one or more beams along one or more axises of the one or more HMAs.

21. A holographic metasurface antennas (HMAs) for forming one or more beams, comprising:

an array of scattering elements that produce the one or more beams based on one or more wave signals; and wherein the HMA provides the one or more beams to a shaper that passively redirects the one or more beams, wherein a physical arrangement of the shaper provides an aperture that is relatively larger than another aperture provided by the one or more HMAs.

22. The HMAs of claim 21, wherein the array of scattering elements is extended along a length of the one or more HMAs in one or more rows that are substantially less than a number of columns for a width of the one or more HMAs.

23. The HMAs of claim 21, further comprising employing two or more HMAs to separately produce the one or more beams along a first axis and a second axis.

24. The HMAs of claim 21, further comprising switching the production of the one or more beams between two or more HMAs to scan two or more different sectors of a focal plane.

25. The HMAs of claim 21, wherein the one or more HMAs are configured as one or more of a static reflect array, a configurable reflect array, a static transmit array, or a configurable transmit array.

26. The HMAs of claim 21, wherein the shaper further comprises one or more of:

a surface curved along one direction and extending laterally relative to the one direction, wherein the scattering elements of the one or more HMAs extend laterally relative to the one direction of the shaper.

27. The HMAs of claim 21, wherein the shaper further comprises:

one or more reflectors, wherein the one or more reflectors include one or more of a parabolic cylindrical reflector, an ellipsoid reflector, a hyperboloid reflector, or a dish reflector; or one or more lenses, wherein the one or more lenses include one or more of a Fresnel lens, a Fourier lens, a biconcave lens, a plano-convex lens, a plano-concave lens, a lenticular lens, or a cylindrical lens.

28. The HMAs of claim 21, wherein the shaper further comprises providing one of positive, negative or zero gain for the one or more redirected beams.

29. The HMAs of claim 21, further comprising another shaper that is arranged to initially receive the one or more beams produced by the one or more HMAs, wherein the initially received one or more beams is redirected by the other shaper to the shaper that passively redirects the one or more beams.

30. The HMAs of claim 21, further comprising:

one or more processors that execute instructions to perform actions, comprising adjusting a response of the array of scattering elements to scan the one or more beams along one or more axises of the one or more HMAs.

* * * * *